US008702369B2

(12) United States Patent
Givens

(10) Patent No.: US 8,702,369 B2
(45) Date of Patent: Apr. 22, 2014

(54) LOAD SENSING DEVICE FOR MANIPULATORS AND BALANCERS

(76) Inventor: Ray Givens, London (CA)

( * ) Notice: Subject to any disclaimer, the term of this patent is extended or adjusted under 35 U.S.C. 154(b) by 355 days.

(21) Appl. No.: 13/110,743

(22) Filed: May 18, 2011

(65) Prior Publication Data

US 2011/0286827 A1 Nov. 24, 2011

Related U.S. Application Data

(60) Provisional application No. 61/345,775, filed on May 18, 2010.

(51) Int. Cl.
*B66C 1/00* (2006.01)

(52) U.S. Cl.
USPC ..... 414/730; 901/48

(58) Field of Classification Search
USPC ..... 414/225.01, 560, 561, 626, 639, 640, 414/645, 646, 647, 680, 729, 730, 731, 732, 414/738, 742; 901/13, 48; 212/276, 195, 212/261, 83, 84, 97, 279; 91/511, 512, 513, 91/517; 137/455; 92/143; 340/685
See application file for complete search history.

(56) References Cited

U.S. PATENT DOCUMENTS 3,608,743 A * 9/1971 Mosher et al. ..... 414/5
4,412,775 A * 11/1983 Molitor et al. ..... 414/626
4,428,710 A * 1/1984 Grisebach et al. ..... 414/590
4,659,276 A * 4/1987 Billett ..... 414/543
4,714,393 A * 12/1987 Betts ..... 414/10
5,245,828 A * 9/1993 Nakamura ..... 60/452
5,305,680 A * 4/1994 Weber ..... 91/1
6,592,321 B2 * 7/2003 Bonker et al. ..... 414/626
6,666,803 B1 * 12/2003 Spatafora ..... 483/16
6,738,691 B1 * 5/2004 Colgate et al. ..... 700/245
6,945,335 B2 * 9/2005 Suzuki et al. ..... 172/812
8,181,799 B2 * 5/2012 Laliberte et al. ..... 212/320
8,226,072 B2 * 7/2012 Murayama ..... 269/55
2008/0187421 A1 * 8/2008 Givens et al. ..... 414/225.01

* cited by examiner

*Primary Examiner* — Saul Rodriguez
*Assistant Examiner* — Glenn Myers
(74) *Attorney, Agent, or Firm* — Katten Muchin Rosenman LLP

(57) ABSTRACT

A load handling system includes a load movement assembly, a lift cylinder, a load holding member, a release control member, a load movement assembly control device, and a load sensing device. The load sensing device includes a housing having a first port and a second port, and a piston movable between the first and second ports, the first port fluidly connectable to the lift cylinder and the second port fluidly connectable to a source of fluid at a third pressure. The piston is operatively connected to the release control member. When the lift cylinder is at the second pressure the piston is driven to a first position which permits the release control member to be actuated to release the load. When the lift cylinder is at the first pressure the piston is driven to a second position which prevents the release control member to be actuated to release the load.

13 Claims, 3 Drawing Sheets

FIGURE 1: MANIPULATOR APPLICATION
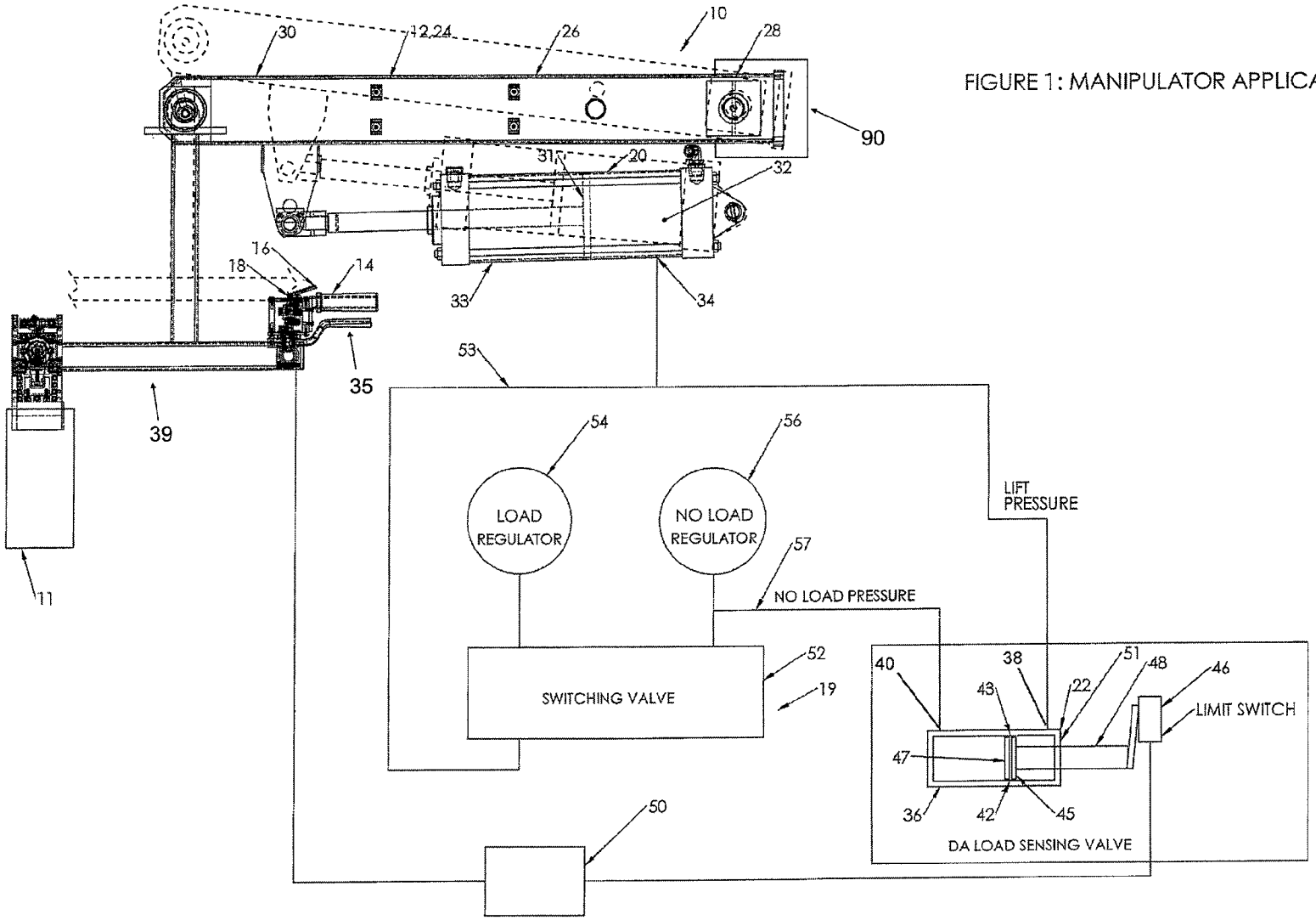

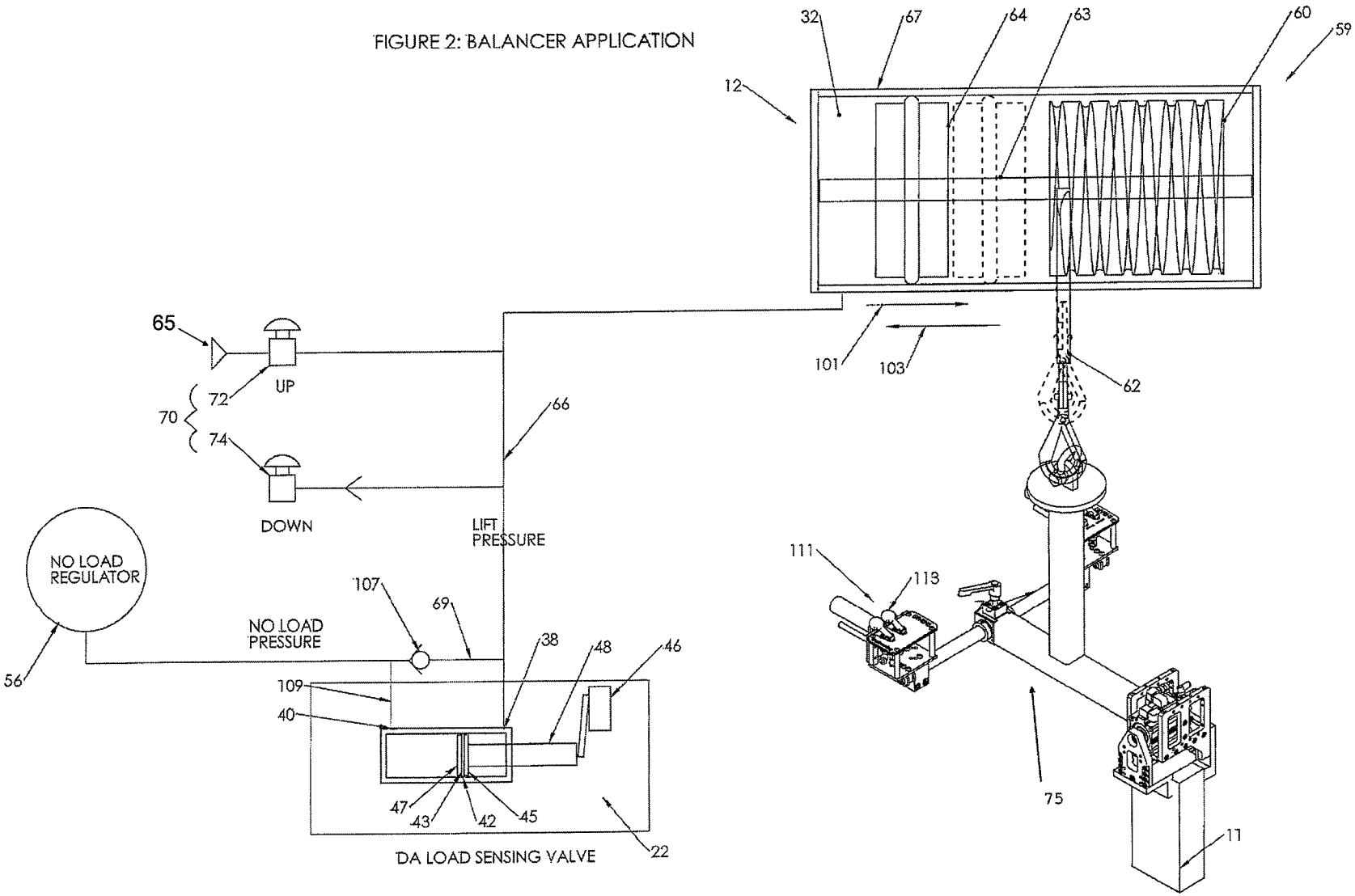
FIGURE 2: BALANCER APPLICATION

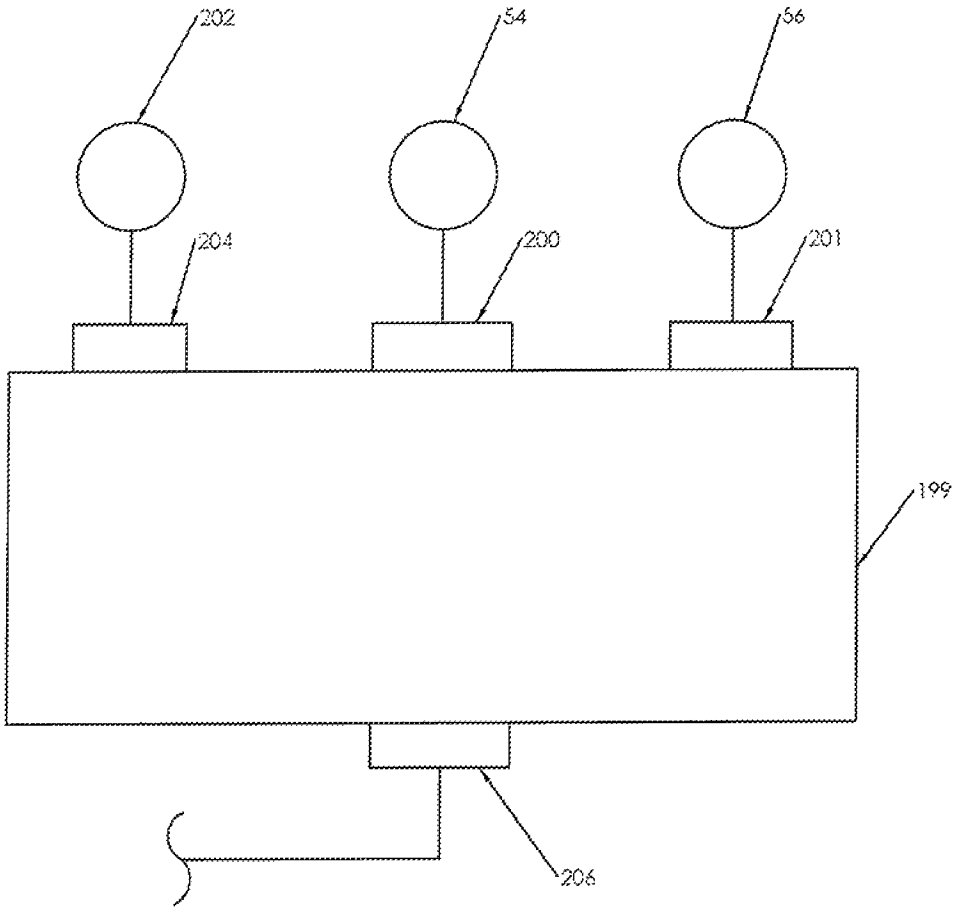
FIGURE 3: SWITCHING VALVE

LOAD SENSING DEVICE FOR MANIPULATORS AND BALANCERS

FIELD OF THE INVENTION

The present invention relates to manipulators and balancers and more particularly to load sensing devices for manipulators and balancers.

BACKGROUND OF THE INVENTION

Pneumatic manipulators and balancers have been used for many years in industry for repetitive lifting of loads. A manipulator includes an arm that lifts a load using a lift cylinder to keep the arm and the load up. A balancer is a hoist that uses a piston moving though a cylinder to lift the load. An end effector hangs from the manipulator or balancer, and incorporates a gripper, vacuum cups, or magnet to hold the load. A human operator operates controls on the end effector to grip or release the load. A problem is that there exists the possibility of the operator accidentally pressing the release button(s) while the load is being carried, resulting in the load falling and causing injury.

A load-sensing device is routinely installed in manipulators and balancers to sense the pressure in the lift cylinder and disable the release function. That is, while the load is being carried, the load-sensing device senses that the pressure in the lift cylinder (or balancer) is higher than it is in the no-load situation, and it prevents the release circuit from operating. Typically, the load-sensing device is an adjustable pneumatic pressure-sensing valve. When pressure rises above an adjustable threshold, or setpoint, an air signal changes state, which can then be used to disable release. The threshold is set manually with a dial or screw to a level somewhat higher than the no-load pressure. When the load is brought down to rest on a support, the lift pressure drops below the threshold to the no-load range, and the gripper can be released.

There are several drawbacks to existing available pneumatic pressure-sensing valves that make them unreliable:

Over time, the adjustable threshold can drift. Over a matter of days or months, the threshold can rise or fall slightly, due to vibration, contaminants in the air supply, repetitive flexing of internal components, and other factors. The result of a slight drop in the threshold is the permanent disabling of release, and a stop in production. If the threshold rises slightly, release can happen too early, making accidental dropping of parts a possibility.

Sometimes the threshold is not repeatable. For example, on one trial, the threshold might be 52 psi, but on the next it might be 54 psi.

Some load-sensing valves have a large hysteresis. For example, when the pressure is rising the output turns on at 61 psi, but when the pressure is falling, the output turns off again at 56 psi.

Some pressure-sensing valves switch states if the pressure very suddenly changes. For example, if the load is bounced up and down while being carried, the pressure-sensor may briefly allow a release to occur.

Pressure-sensing valves have to be adjusted by a person who understands how to make an accurate setup. If the no-load pressure changes, or if the setpoint has drifted, it will be up to a mechanic in the end user's factory to make this adjustment, which can lead to errors, and a loss in production.

Pneumatic pressure-sensing valves cannot reliably detect very light loads. If an end effector weighs 120 lb, the heaviest load weighs 100 lb, and the lightest weighs 20 lbs, typically the load-sensing valve will not be able to detect the presence or absence of the light load. The no-load pressure (that is, the pressure required to suspend an empty end effector) may be 50 psi, and the pressure required to lift the lightest load may be 54 psi. This 4 psi difference cannot be reliably detected by some pneumatic pressure-sensing valves.

SUMMARY OF THE INVENTION

In a first aspect, the invention is directed to a load handling system that includes a load movement assembly, a lift cylinder, a load holding member, a release control member, a load movement assembly control device and a load sensing device. The load movement assembly is movable between a raised position and a lowered position. The load holding member is connected to the load movement assembly and controllable to hold a load and to release the load. The lift cylinder is operatively connected to the load movement assembly and movable to raise and lower the load. The release control member is operatively connected to the load holding member to control release of the load. The load movement assembly control device is actuatable between a first state wherein the load movement assembly control device connects the lift cylinder to a source of fluid at a first pressure, and a second state wherein the load movement assembly control device connects the lift cylinder to a source of fluid at a second pressure. The first pressure is selectable so that the lift cylinder at least partially supports the weight of the load movement assembly and the load. The second pressure is less than the first pressure and is selectable to be sufficient for the lift cylinder to at least partially support the weight of load movement assembly without the load and to be insufficient for the lift cylinder to support the weight of the load movement assembly with the load. The load sensing device includes a housing having a first port and a second port, and a piston movable between the first and second ports. The first port is fluidly connectable to the lift cylinder. The second port is fluidly connectable to a source of fluid at a third pressure. The piston is operatively connected to the release control member. When the lift cylinder is at the second pressure the piston is driven to a first position which permits the release control member to be actuated to release the load, and wherein when the lift cylinder is at the first pressure the piston is driven to a second position which prevents the release control member to be actuated to release the load.

In an embodiment, the load handling system is a manipulator system.

In an embodiment, the source of the fluid at the third pressure is the same as the source of the fluid at the second pressure. Additionally the piston has a piston body which has a first face fluidly connected to the first port and which has a first effective area and a second face fluidly connected to the second port and having a second effective area that is greater than the first effective area.

BRIEF DESCRIPTION OF THE DRAWINGS

The present invention will now be described by way of example only with reference to the attached drawings, in which:

FIG. 1 is a schematic view of a manipulator in accordance with an embodiment of the present invention;

FIG. 2 is a schematic view of a balancer in accordance with an embodiment of the present invention; and FIG. 3 is a schematic view of a switching valve that can be used with the system shown in FIG. 1.

DETAILED DESCRIPTION OF THE INVENTION

Reference is made to FIG. 1, which shows a load handling system 10 in accordance with an embodiment of the present invention. The load handling system 10 permits a user to hold a load (shown at 11), to raise the load 11, to move the load 11, to lower the load 11 and to release the load 11.

The load handling system 10 may take any suitable form. For example, the load handling system 10 may be a manipulator system as shown in FIG. 1, or may be a balancer system as shown in FIG. 2. In the embodiments shown in FIGS. 1 and 2 the load handling system 10 includes a load movement assembly 12 movable over a range of movement, including a raised position and a lowered position, a load holding member 14, which is controllable to hold a load 11 and to release the load 11, a set of controls 16, a lift cylinder 20 operatively connected to the load movement assembly 12 and movable to raise and lower the load 11, and a load sensing device 22 that is used to determine whether the load handling system 10 a load 11 is being held in the air or not. If the load sensing device 22 determines that there is a load 11 being held above the ground, then the load sensing device 22 does not permit the load holding member 14 to release the load 11. If the load sensing device 22 determines that there is not a load being held above the ground by the load handling system 10 (ie. which means either that a load being held is safely supported on the ground or on some other support and does not represent a risk of being dropped from a height, or that there is no load being held by the load handling system 10), the load sensing device 22 permits the load holding member 14 to release a load if it is holding one.

The load movement assembly 12 in the embodiment shown in FIG. 1 includes an arm assembly 24. The arm assembly 24 has a base end 28 and a free end 30. The base end 28 is pivotally mounted to a base 90. The free end 30 has the load holding member 14 mounted thereto. In a preferred embodiment, the load holding member 14 is pivotally mounted to the free end 30 of the arm assembly 24.

The arm assembly 24 in FIG. 1 includes a single arm 26. It is alternatively possible, however for the arm assembly 24 to include a plurality of arms (eg. two arms), which are pivotally connected end to end, thereby forming an articulating system that can reach a wider range of points on the ground.

The lift cylinder 20 is a fluid actuated cylinder including a piston 31 movable in a housing 33. The lift cylinder 20 is connected between the arm assembly 24 and a base (not shown). By virtue of their weight, the load movement assembly 12 and the load 11 exert a force on the lift cylinder 20 urgent the piston 31 to retract into the housing 33. The housing 33 has a port 34 which is connectable through fluid conduit 53 to a source of fluid 32 at a first pressure, which may be referred to as a load pressure. The load pressure is a pressure sufficient to cause the lift cylinder 20 to at least partially support the load movement assembly 12 and the load 11. Preferably, the load pressure is a pressure sufficient to cause the lift cylinder 20 to substantially support the load movement assembly 12 and the load 11. The value of the load pressure may be controlled at least in part by a first regulator, shown at 54, which may be referred to as a load pressure regulator. The load pressure regulator 54 may be adjustable by an operator of the manipulator system to adjust the load pressure based on the weight of the arm assembly 24 and the load 11 being lifted. The load pressure regulator 54 may be referred to as a source of fluid at a first pressure, or a source of fluid at a load pressure.

In a preferred embodiment, the load pressure is selected to be sufficient to substantially support the load movement assembly 12 and the load 11 but to be insufficient to cause the lift cylinder 20 to extend and raise the arm assembly 24. When the load pressure is applied to the lift cylinder 20, the operator of the manipulator system 10 can manually lift a load 11 held by the load holding member 14 using handles shown at 35. Because of the load pressure in the lift cylinder 20, the force that the operator would have to use to raise the arm assembly 24 and the load 11 is relatively small, as compared to a situation where the operator had to pick up the load himself/herself, without the use of the manipulator system. The position of the arm assembly 24 and lift cylinder 20 when the arm assembly 24 is raised is shown in dashed lines in FIG. 1.

To lower the arm assembly 24 when it is holding a load in a raised position, the pressure may be decreased in the fluid 32 to a second pressure, which may be referred to as a no-load pressure. The no-load pressure is less than the load pressure and may be selected to be sufficient to cause the lift cylinder 20 to at least partially support the arm assembly 24 without the load 11. The no-load pressure is preferably selected to be sufficient to cause the lift cylinder 20 to substantially support the arm assembly 24 without the load 11, while being insufficient to support the arm assembly 24 with the load 11 and while being insufficient to cause the lift cylinder 20 to extend and raise the arm assembly 24. As a result, the weight of the arm assembly 24 and the load 11 together cause the arm assembly 24 and load 11 to move lower. The value of the no-load pressure may be controlled at least in part by a second regulator, shown at 56, which may be referred to as a no-load pressure regulator. The no-load pressure regulator 56 may be adjustable by an operator of the manipulator system to adjust the no-load pressure based on the weight of the arm assembly 24.

The no-load pressure regulator 56 may be referred to as a source of fluid at a second pressure, or a source of fluid at a no-load pressure.

The load holding member 14 may be made up of any suitable structure. For example, it may comprise a set of grippers that are movable between a closed position where they hold the load 11 and an open position where they release the load 11 and/or where they are ready to receive another load 11.

The set of controls 16 controls the operation of the load handling system 10. One particular member that is part of the set of controls 16 is a release control member 18 (such as a lever or a pair of buttons), which is operatively connected to the load holding member 14 to control release of the load 11. The controls 16 and the load holding member 14 may be provided all together in an end effector 39 that is pivotally connected to the free end 30 of the arm assembly 24.

A load movement assembly control device 19 is provided which controls the operation of the load movement assembly 12. In the embodiment shown in FIG. 1, the load movement assembly control device 19 may be referred to as an arm assembly control device. The load movement assembly control device 19 may have any suitable structure, such as for example, one or more buttons or a lever. In the embodiment shown in FIG. 1, the load movement assembly control device 19 includes a switching valve 52, which is movable between a first position in which it connects the lift cylinder 20 to fluid from the load regulator 54, and a second position in which it connects the lift cylinder 20 to fluid from the no-load regulator 56.

The load sensing device 22 includes a housing 36 having a first port 38 and a second port 40, and a piston 42 movable in the housing 36. The first port 38 is connectable to fluid 32 at the arm assembly control pressure through conduit 55, which connects to conduit 53. The second port 40 is connectable through conduit 57 to a source of fluid 32 at a third pressure. In an embodiment, the source of fluid 32 at the third pressure is the source of fluid 32 at the second pressure (ie. the no-load pressure regulator), and thus the third pressure is the same as the second pressure. In embodiments wherein the third pressure is not the same as the second pressure, the third pressure is nonetheless lower than the first pressure.

The piston 42 includes a piston body 43 that has a first face 45 and a second face 47. The first face 45 is in fluid communication with the first port 38 and the second face 47 is in fluid communication with the second port 40. The piston 42 further includes a piston rod 48 that extends from the first face 45 of the piston body 43 and extends out through a first end, shown at 51 of the housing 36 is operatively connected to the release control member 18, such that movement of the piston 42 to a first position permits the release control member 18 to be actuated to release the load 11, and movement of the piston 42 to a second position prevents the release control member 18 to be actuated to release the load 11.

When the load movement assembly control device 19 has been actuated to move the switching valve 52 to its first position to connect the lift cylinder 20 to the load pressure regulator 54, the pressure differential between the first pressure acting on the first face 45 of the piston body 43 and the third pressure acting on the second face 47 drives the piston 42 to its second position. When the load movement assembly control device 19 has been actuated to move the switching valve 52 to its second position to connect the lift cylinder 20 to the no-load pressure regulator 56, there may not be a pressure differential between the second pressure acting on the first face 45 of the piston body 43 and the third pressure acting on the second face 47, if the source of fluid at the third pressure is the same as the source of fluid at the second pressure. However, because the piston rod 48 occupies some of the area of the first face 45, the effective area of the first face 45 is less than the effective area of the second face 47. For greater certainty, the effective area of the first or second face of the piston body 43 is the effective area on which fluid urges the piston body 43 in one direction or the other in the housing 36. As a result, when there is the same pressure (ie. the no-load pressure) at both ports 38 and 40 of the housing 36, the piston 42 is urged towards its first position whereat it engages a limit switch 46 which is electrically connected to the release control member 18 in such a way that the actuation of the switch 46 enables the release control member 18. This may be achieved via any suitable electrical circuit (not shown), or alternatively, the switch 46 may send a signal to a controller shown at 50, which processes the signal and in turn enables the release control member 18 to be operated. While the embodiment shown closes the switch 46 by movement of the piston 42 to the second position, it is alternatively possible for a different kind of switch 46 to be provided which would be opened by movement of the piston 42 to the second position. In either case, the switch 46 changes state when the piston 42 reaches the first position thereby permitting release of the load 11, and changes state when moving from the first position to the second position thereby preventing release of the load 11. While a limit switch is shown in FIG. 1, the structure that operatively connects the piston 42 to the release control member 18 may be any suitable structure.

Having the source of the third pressure and the source of the second pressure be the same source (ie. the no-load regulator 56) is advantageous because the piston 42 will still move to its first position to permit release of the load 11 even if the pressure setting on the no-load regulator 56 controlling the no-load pressure drifts during operation of the load handling system 10.

As a result, if the switching valve 52 is set to send fluid 32 at the load pressure to the lift cylinder (which implies that a load 11 is being lifted and moved), the piston 42 will move to the second position to prevent an operator from inadvertently actuating the release control member 18 to release the load 11 while the load 11 is in the air. If the operator moves the switching valve 52 to send the no-load pressure to the lift cylinder 20 while the load 11 is in the air, the arm assembly 24 will lower as its own weight combined with that of the load 11 overcomes the reduced pressure in the lift cylinder 20 urging fluid 32 to vent from the lift cylinder 20 and conduit 53. In an embodiment wherein the fluid 32 is air, the venting of the fluid 32 may be achieved any suitable way, such as through the no-load regulator 56. The lowering of the arm assembly 24 will cause the piston 31 in the cylinder 20 to retract, thereby reducing the effective volume of the lift cylinder 20. This in turn keeps the fluid pressure in the lift cylinder 20 above the no-load pressure during lowering of the arm assembly 24. As a result, during lowering of the arm assembly 24, the pressure at the first port 38 remains higher than the no-load pressure at the second port 40 of the load sensing device housing 36, and so the piston 42 remains in the second position preventing release of the load 11. When the load 11 comes to rest on the ground or on some other support, the arm assembly 24 no longer lowers and thus the piston 31 stops retracting. As a result, the volume in the lift cylinder 20 remains constant, as which point the continued venting of the fluid 32 over some period of time (eg. a second or a few seconds) reduces the pressure in the lift cylinder 20 and the conduit 53 to reach equilibrium at the no-load pressure. As the pressure in the conduit 53 (and therefore at the first port 38) approaches the no-load pressure, the force of the fluid 32 on the second face 47 of the piston body 32 overcomes the force of the fluid 32 on the first face 45, thereby urging the piston 42 to its first position. When the piston 42 reaches the first position it permits the release control member 18 to be actuated to release the load 11 if desired by the operator.

The load sensing device 22 may be a fluid actuated cylinder.

The fluid 32 may be any suitable kind of fluid, such as air or hydraulic oil.

In the embodiment shown in FIG. 1, a single load regulator 54 is provided. This load regulator 54 may be set by an operator or installer of the system 10 so that the arm assembly substantially supports a particular weight of load 11. As such, if a significantly lighter or heavier load 11 is picked up by the system 10, the pressure setting for the load regulator 54 could be adjusted accordingly. If it is not adjusted, the operator would have to support a significantly larger part of the load (in the case of a heavier load), or the machine would tend to raise the arm assembly 24 by itself (in the case of a lighter load). As shown in FIG. 3, the system 10 can be configured in several ways to handle situations where more than one weight of load needs to be handled. For example, in situations where the system 10 will have to handle a small number of different load weights (eg. 2 different load weights), additional load regulators can be provided and can be selected using an appropriate switching valve shown at 199 that can select between 3 or more inlets and a single outlet. The first load regulator 54 would communicate fluid 32 at the first pressure with a first valve inlet port shown at 200. The no-load regulator 56 would communicate fluid 32 at the second pressure with a first valve inlet port shown at 201. The second port 40 of the load sensing device housing 36 would receive fluid 32 at the third pressure. A second load regulator 202 would communicate fluid 32 at a fourth pressure with a third valve port shown at 204. The valve outlet is shown at 206 and communicates fluid 32 from one of the inlet ports 200, 201 and 204 to the lift cylinder 20 (FIG. 1).

In another embodiment, the operator may not know a priori the weight of the load 11 that is to be picked up and moved. For example, the operator may be picking up and moving a variety of different types of load. In such a situation, a relatively more complex system may be provided to provide the first pressure which is adjusted as necessary based on the particular load being picked up.

In the embodiment shown in FIG. 2, the load handling system is shown at 59 and is a balancer. In this embodiment, the load movement assembly 12 includes a drum 60 and a cable 62 that winds around the drum 60. The drum 60 is mounted on a threaded member 63 in a housing 67. A piston 64 is movable in the housing 67 in a first direction shown by arrow 101 by pressurized fluid 32 in conduit 66. The movement of the piston 64 in the first direction causes rotation of the drum 60 in a winding direction to wind cable 62 on the drum 60 thereby lifting the load 11. Movement of the piston 64 and winding of the cable 62 are shown in dashed lines in FIG. 2.

A load holding member 75 is provided at the free end of the cable 62 for holding the load 11. The load holding member 75 may be similar to the load holding member 14. A set of controls 111 including a release control member 113 may be provided on the load holding member 75 to permit release of the load 11 from the load holding member.

The load sensing device 22 may be similar to the load sensing device 22 in FIG. 1. The conduit 66 is fluidly connected to the first port 38. The second port 40 is fluidly connected to a source of fluid 32 at a no-load pressure, which may be controlled by the no-load regulator 56, and which may be referred to as a third pressure.

In similar fashion to the load sensing device 22 in FIG. 1, the piston 42 is configured to move to its first position to permit release of the load 11 when the pressure at the first port 38 approaches the no-load pressure as a result of the difference in the effective area on the first face 45 of the piston 42 and the second face 47 of the piston body 43. When the pressure in the conduit 66 is significantly larger than the no-load pressure the piston 42 is moved to its second position thereby preventing release of the load 11.

A load movement assembly control device 70 includes a first valve 72 and a second valve 74. When the first valve 72 is open and the second valve 74 is closed the conduit 66 is connected to a source of fluid 65 at a first pressure which is sufficient to drive the piston 64 in the first direction against the weight of the load holding member 75 and the load 11. When the first valve 72 is closed and the second valve 74 is closed, pressure from the no-load regulator shown at 56 is sent to the conduit 66 through conduit 69. The pressure from the no-load regulator 56 may be referred to as a no-load pressure. The pressure from the no-load regulator 56 is sufficient to drive the piston 64 in the first direction against the weight of the load holding member 70 when there is no load 11. When the first valve 72 is closed and the second valve 74 is open the conduit 66 and the housing 67 are vented to a second pressure. The venting may be to atmosphere in embodiments wherein the fluid 65 is air. The venting of the conduit 66 drops the pressure in the conduit 66 and the housing 67, at which point a load 11 held in the load holding member 75 is no longer supported, which causes the unwinding of the cable 62 from the drum 60, thereby driving the drum to rotate in an unwinding direction, which in turn drives the piston 64 to move in a second direction shown by arrow 103, thereby reducing the effective volume of the housing 67. Thus, as the load 11 is lowered, the volume of the housing 67 reduces, which keeps the pressure in the housing 67 and conduit 66 above the no-load pressure.

When the load 11 comes to rest on the ground or on some other support, the drum 60 is no longer being caused to rotate and thus the piston 64 is no longer being driven to move in the second direction. Thus the volume of the housing 67 remains constant. Holding the valve 74 open after the load 11 is supported on the ground or other support permits venting of the housing 67 and consequent reduction in pressure in the housing 67, however. At some point pressure in the conduit 66 reduces to a level that is sufficiently close to the no-load pressure that the piston 42 in the load sensing device 22 moves to its first position, thereby permitting release of the load 11.

A check valve shown at 107 is provided to prevent fluid 65 at the first pressure from entering the conduit shown at 109 which connects the no-load regulator 56 to the second port 40 when the valve 72 is open.

It will be noted that it would be possible to use the load movement assembly control device 19 with the balancer system 59 instead of using the load movement assembly control device 70. Additionally, that it would be possible to use the load movement assembly control device 70 with the manipulator system 10 instead of using the load movement assembly control device 19.

While the above description constitutes a plurality of embodiments of the present invention, it will be appreciated that the present invention is susceptible to further modification and change without departing from the fair meaning of the accompanying claims.

The invention claimed is:

1. A load handling system, comprising:

a load movement assembly movable between a raised position and a lowered position;

a load holding member connected to the load movement assembly and controllable to hold a load and to release the load;

a lift cylinder operatively connected to the load movement assembly and movable to raise and lower the load;

a release control member operatively connected to the load holding member to control release of the load;

a load movement assembly control device movable between a first load movement assembly control device position wherein the load movement assembly control device connects the lift cylinder to a source of fluid at a first pressure, and a second load movement assembly control device position wherein the load movement assembly control device connects the lift cylinder to a source of fluid at a second pressure, wherein the first pressure is selectable so that the lift cylinder at least partially supports the weight of the load movement assembly and the load, wherein the second pressure is less than the first pressure and is selectable to be sufficient for the lift cylinder to at least partially support the weight of load movement assembly without the load and is insufficient for the lift cylinder to support the weight of the load movement assembly with the load; and a load sensing device including a housing having a first port and a second port, and a piston movable between the first and second ports, wherein the first port is fluidly connectable to the lift cylinder, wherein the second port is fluidly connectable to a source of fluid at a third pressure, wherein the piston is operatively connected to the release control member, and wherein when the lift cylinder is at the second pressure the piston is driven to a first piston position which permits the release control member to be actuated to release the load, and wherein when the lift cylinder is at the first pressure the piston is driven to a second piston position which prevents the release control member to be actuated to release the load.

2. A load handling system as claimed in claim 1, wherein the first pressure is at least as high as the third pressure and wherein the third pressure is at least as high as the second pressure.

3. A load handling system as claimed in claim 1, wherein the second and third pressures are substantially identical, and wherein the piston has a piston body which has a first face fluidly connected to the first port and which has a first effective area and a second face fluidly connected to the second port and having a second effective area that is greater than the first effective area.

4. A load handling system as claimed in claim 1, wherein the second pressure is atmospheric pressure.

5. A load handling system as claimed in claim 1, wherein the load movement assembly control device includes a first valve that is actuatable to fluidly connect the lift cylinder to the source of fluid at the first pressure and a second valve that is actuatable to vent the lift cylinder to atmosphere.

6. A load handling system as claimed in claim 1, wherein the first pressure is controlled by a first regulator and the second pressure is controlled by a second regulator and wherein the third pressure is controlled by the second regulator so that the second and third pressures are substantially identical.

7. A load handling system as claimed in claim 1, wherein the load movement assembly includes an arm assembly mountable to a base and movable relative to the base.

8. A load handling system as claimed in claim 1, wherein the load movement assembly includes a cable reel, a cable mounted at a first end to the cable reel, and an actuation piston, movable by fluid at the first pressure.

9. A load handling system as claimed in claim 1, wherein the load has a first weight and wherein the load movement assembly control device actuatable between the first position, the second position and a third position wherein the load movement assembly control device connects the lift cylinder to a source of fluid at a fourth pressure, wherein the fourth pressure is selectable to be greater than the first pressure and to be sufficient so that the lift cylinder at least partially supports a load having a second weight that is heavier than the first weight.

10. A load handling system as claimed in claim 1, wherein the fluid is air.

11. A manipulator system, comprising:

an arm assembly movable between a raised position and a lowered position;

a load holding member connected to the arm assembly and controllable to hold a load and to release the load;

a lift cylinder operatively connected to the arm assembly and movable to raise and lower the load;

a release control member operatively connected to the load holding member to control release of the load;

an arm assembly control device movable between a first state wherein the arm assembly control device connects the lift cylinder to a source of fluid at a load pressure, and a second state wherein the arm assembly control device connects the lift cylinder to a source of fluid at a no-load pressure, wherein the load pressure is selectable so that the lift cylinder substantially supports the weight of the arm assembly and the load, wherein the no-load pressure is less than the load pressure and is selectable so that the lift cylinder substantially supports the weight of arm assembly without the load and to be insufficient for the lift cylinder to support the weight of arm assembly with the load; and a load sensing device including a housing having a first port and a second port, and a piston movable between the first and second ports, wherein the first port is fluidly connectable to the lift cylinder, wherein the second port is fluidly connectable to the source of fluid at the no-load pressure, wherein the piston is operatively connected to the release control member, wherein the piston has a piston body which has a first face fluidly connected to the first port and which has a first effective area and a second face fluidly connected to the second port and having a second effective area that is greater than the first effective area.

12. A manipulator system as claimed in claim 11, wherein the housing of the load sensing device has a first end and a second end, wherein piston includes a piston rod that extends from the first face of the piston body and passes through the first end of the housing.

13. A manipulator system as claimed in claim 11, wherein the load has a first weight and wherein the arm assembly control device is actuatable between the first state, the second state and a third state wherein the arm assembly control device connects the lift cylinder to a source of fluid at a second load pressure, wherein the second load pressure is selectable to be greater than the first load pressure and to be sufficient so that the lift cylinder substantially supports a load having a second weight that is heavier than the first weight.

* * * * *